US008636319B1

(12) United States Patent
Parker, Jr.

(10) Patent No.: US 8,636,319 B1
(45) Date of Patent: Jan. 28, 2014

(54) CUP HOLDER SUPPORT APPARATUS

(76) Inventor: Don Parker, Jr., Enterprise, AL (US)

( * ) Notice: Subject to any disclaimer, the term of this patent is extended or adjusted under 35 U.S.C. 154(b) by 486 days.

(21) Appl. No.: 12/903,487

(22) Filed: Oct. 13, 2010

Related U.S. Application Data

(60) Provisional application No. 61/251,203, filed on Oct. 13, 2009.

(51) Int. Cl.
*A47C 7/62* (2006.01)

(52) U.S. Cl.
USPC ..... 297/188.12; 297/188.2; 297/188.21; 248/311.2

(58) Field of Classification Search
USPC ..... 297/188.08, 188.12, 188.18, 188.2, 297/188.21; 248/311.2, 312.1, 312
See application file for complete search history.

(56) References Cited

U.S. PATENT DOCUMENTS

| | | | | | |
|---|---|---|---|---|---|
| 2,063,554 | A | * | 12/1936 | Meyerson | 248/106 |
| D153,000 | S | * | 3/1949 | Mehlhaff | D6/556 |
| 2,601,571 | A | * | 6/1952 | Sverkerson | 211/74 |
| 2,719,414 | A | * | 10/1955 | Davis | 220/738 |
| 2,781,992 | A | * | 2/1957 | Cunningham | 131/241 |
| 3,508,732 | A | * | 4/1970 | Trachtenberg et al. | 248/231.71 |
| 4,560,128 | A | * | 12/1985 | Willeby et al. | 248/230.4 |
| 4,697,780 | A | * | 10/1987 | Wenkman et al. | 248/558 |
| 4,799,731 | A | * | 1/1989 | Brown | 297/188.12 |
| 4,887,784 | A | * | 12/1989 | Kayali | 248/311.2 |
| 4,961,555 | A | * | 10/1990 | Egan, Jr. | 248/231.81 |
| 5,085,391 | A | * | 2/1992 | Berger et al. | 248/311.2 |
| 5,487,517 | A | * | 1/1996 | Smith | 248/215 |
| 5,586,804 | A | * | 12/1996 | Burroughs | 297/188.08 |
| 5,695,162 | A | | 12/1997 | DiCastro | |
| 5,813,646 | A | * | 9/1998 | Bartholomae | 248/311.2 |
| 6,010,104 | A | * | 1/2000 | Hanson et al. | 248/311.2 |
| D439,429 | S | * | 3/2001 | Higgs et al. | D6/368 |
| 6,264,153 | B1 | * | 7/2001 | Ragner et al. | 248/311.2 |
| 6,283,042 | B1 | * | 9/2001 | Wargo et al. | 108/26 |
| 6,478,371 | B1 | * | 11/2002 | Clarke | 297/188.11 |
| 6,682,034 | B1 | * | 1/2004 | Vial | 248/231.81 |
| 6,766,912 | B1 | * | 7/2004 | Gibbs | 211/74 |
| D517,373 | S | | 3/2006 | Cappellino et al. | |
| 7,036,784 | B2 | * | 5/2006 | Peitzmeier et al. | 248/311.2 |
| 7,128,369 | B2 | * | 10/2006 | Boggs et al. | 297/188.08 |
| 7,413,154 | B2 | * | 8/2008 | Harshman et al. | 248/311.2 |

(Continued)

OTHER PUBLICATIONS

YuppieCuppie.com, Cup Holder for Bleacher & Stadium seating, Web page—http://yuppiecuppie.com.

*Primary Examiner* — David R. Dunn
*Assistant Examiner* — David E Allred
(74) *Attorney, Agent, or Firm* — Garvey, Smith, Nehrbass & North, L.L.C.; Seth M. Nehrbass; Charles C. Garvey, Jr.

(57) ABSTRACT

A stadium seat cup holder for use with a stadium seat having an upper seating panel and multiple other panels includes a bracket that is configured to form an attachment to a stadium seat wherein the bracket affixes to one or more seat panels of the stadium seat. At least one recess on the bracket receives a panel of the stadium seat. A cup holder is preferably movably mounted to the bracket, wherein the cup holder is movable between extended and retracted positions. In the extended position, the cup holder is placed in front of the stadium seat. In the retracted position, the cup holder is placed under the stadium seat. Fittings on the apparatus enable support of other optional items, such as a drink bottle, trash bag, and/or shaker.

14 Claims, 23 Drawing Sheets

(56) References Cited

U.S. PATENT DOCUMENTS

| | | | | |
|---|---|---|---|---|
| 7,530,632 | B2 * | 5/2009 | Kaloustian et al. | 297/188.14 |
| 7,533,854 | B2 * | 5/2009 | Aube | 248/95 |
| 7,549,702 | B2 * | 6/2009 | Meyers | 297/344.18 |
| RE41,624 | E * | 9/2010 | Bergin | 248/311.2 |
| D650,692 | S * | 12/2011 | Miller | D9/620 |
| D669,316 | S * | 10/2012 | Sanders | D7/619.2 |
| 8,333,429 | B2 * | 12/2012 | Nelson et al. | 297/188.18 |
| 2004/0222345 | A1 * | 11/2004 | Lindsay | 248/311.2 |

* cited by examiner

CUP HOLDER SUPPORT APPARATUS

CROSS-REFERENCE TO RELATED APPLICATIONS

Priority of U.S. Provisional Patent Application No. 61/251,203, filed 13 Oct. 2009, hereby incorporated by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to cup holders. More particularly, the present invention relates to cup holders for stadium seats. Even more particularly, the present invention relates to an improved cup holder that has a specially configured bracket that enables attachment to a stadium seat and wherein there is a ring-shaped holder that moves between storage and extended positions, the storage position placing the ring-shaped holder and a contained cup under the stadium seat.

2. General Background of the Invention

Various cup holders have been proposed for stadium seats. The following possibly relevant U.S. Patents are incorporated herein by reference: U.S. Pat. No. 5,695,162 and D517373. A product known as the "yuppie cuppie" is said to be "an effective cupholder for bleacher seating," (See http://yuppiecuppie.com also incorporated herein by reference).

BRIEF SUMMARY OF THE INVENTION

The apparatus of the present invention includes a cup holder for use with a stadium seat. In some embodiments, the cup can be moved to a storage position under a seat. It is advantageous over similar prior cup holders in that it rotates, slides or otherwise is received underneath a seat, and it can include a moving ring (smaller, more compact). The ring can optionally include fittings enabling support of or holding of a bottle, trash bag, and/or shaker.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
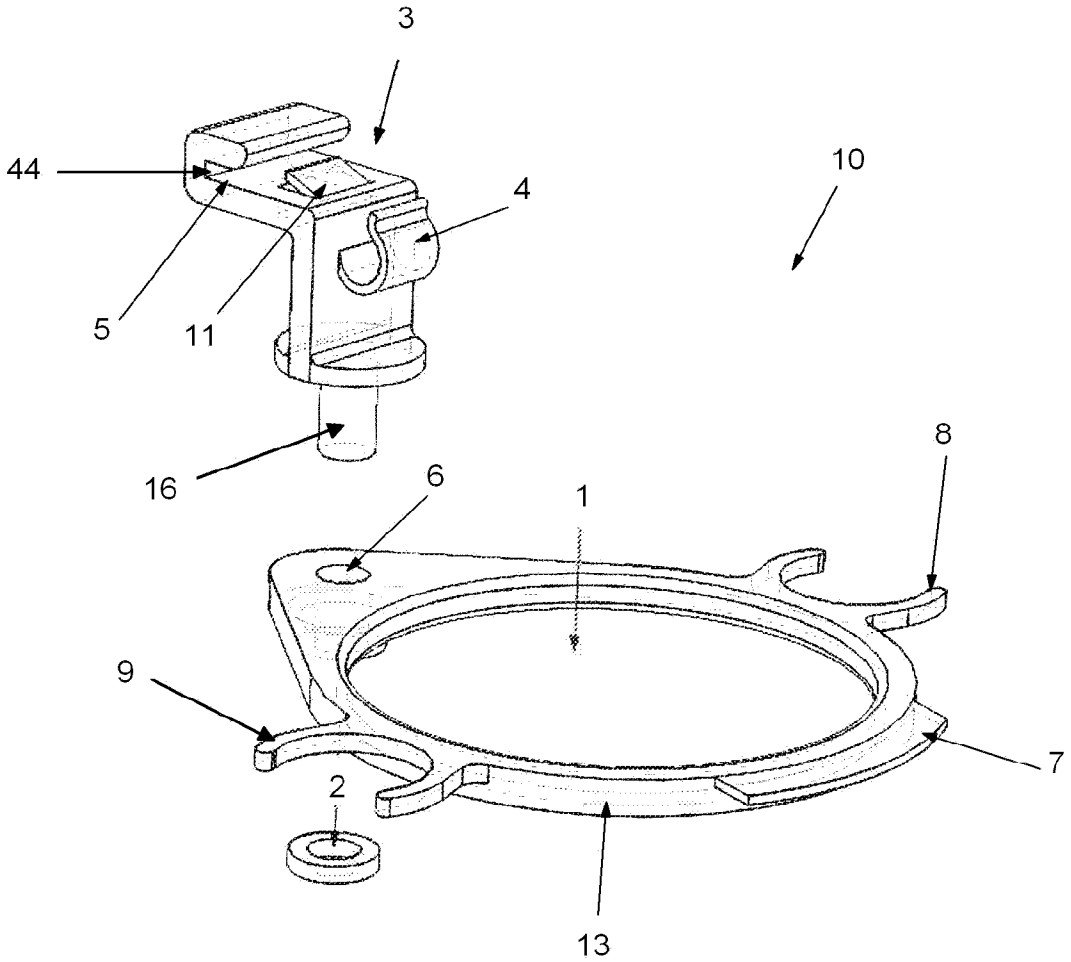
FIG. 1 is an exploded perspective view of a first embodiment of the apparatus of the present invention.

FIG. 1 shows a bleacher or stadium seat 12 attachable cup holding device 10 which can be constructed or molded in separate connectable pieces of a resilient plastic or other suitable structural material.

A first piece is a bracket clip/shaft 3 which includes lip clip 5. The bottom leg of clip 5 extends horizontally away from clip 5 and far enough out to contain a small angled flange 11. Flange 11 is emanating from this bottom leg and raises up. Its open end extends back towards clip 5. Clip/shaft bracket 3 then extends downwardly (from slightly beyond emanation point of angled flange 11) as a vertical flat shaft before transition or morphing into cylindrical shaft 16. Shaft or post 16 allows connection to a second piece, a cup/bottle holding support 1. The clip/shaft bracket 3 also has an upward curved flange 4 protruding out of the vertical flat shaft for holding shakers.

The second piece, cup/bottle holding support 1 comprises a cup holding ring 13 housing a hole 6 at its connecting (to cylindrical shaft 16) end through which passes the slightly smaller diametrically cylindrical shaft 16. Shaft 16 can be secured after passage through hole 6 by a connectable (e.g. adhesive, glued on) ring cap 2. The hole 6 can be larger slightly than the cylindrical shaft 16 to allow ring 13 to rotate about 180 degrees from a position in front of bleacher to a position under a bleacher 12, as illustrated by arrows 36 in FIGS. 2, 6, and 7. Support 1 can optionally contain two pair (one on left side of ring and one on right side of ring) of curved flanges 8, 9 extending off of the ring 13 horizontally. These flanges 8, 9 are set apart far enough and are curved enough to allow a narrowed portion of a bottleneck 14 of bottle 27 to securely rest in them (see FIGS. 3 and 9). Another part of apparatus 10 can be a short, but wide trash bag mount or hanger 7 extending horizontally off of the ring 13 and directly between the two pair of bottle holding curved flanges 8, 9 and directly opposite the hole 6 at apex of ring 13 (see FIG. 1).

Figure 2:
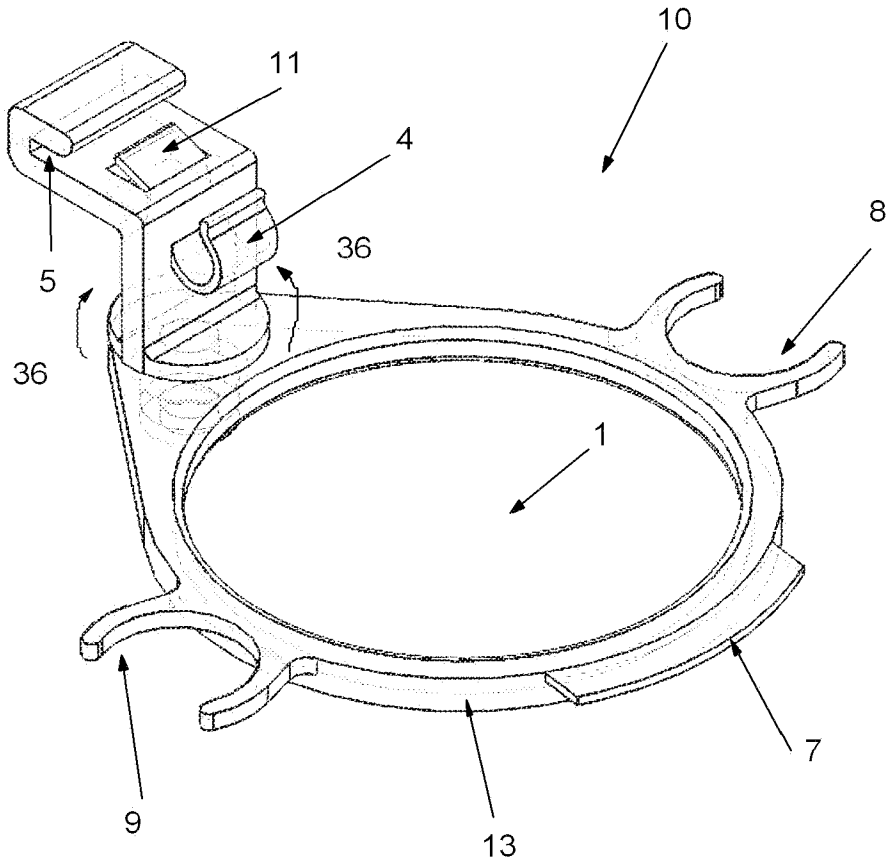
FIG. 2 is a perspective view of the first embodiment of the apparatus of the present invention.
Figure 3:
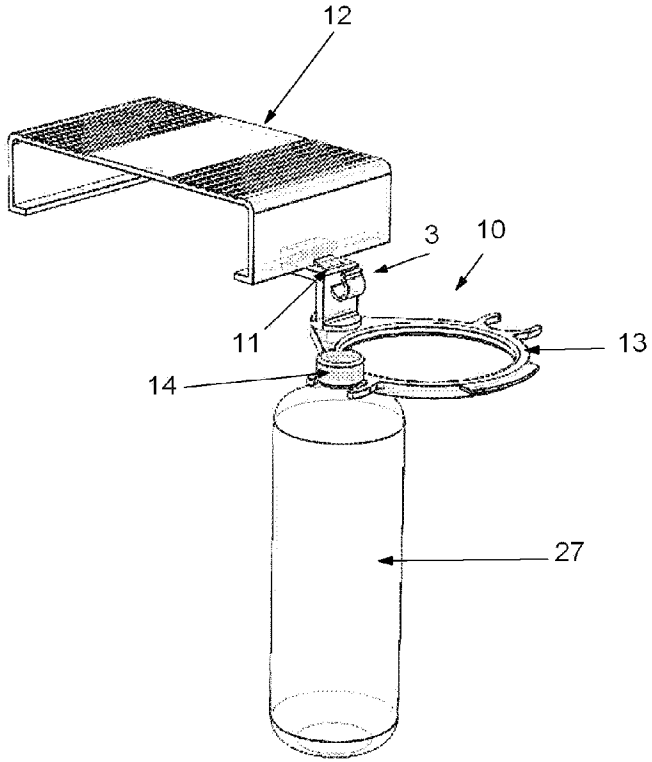
FIG. 3 is a perspective view of the first embodiment of the apparatus of the present invention.
Figure 4:
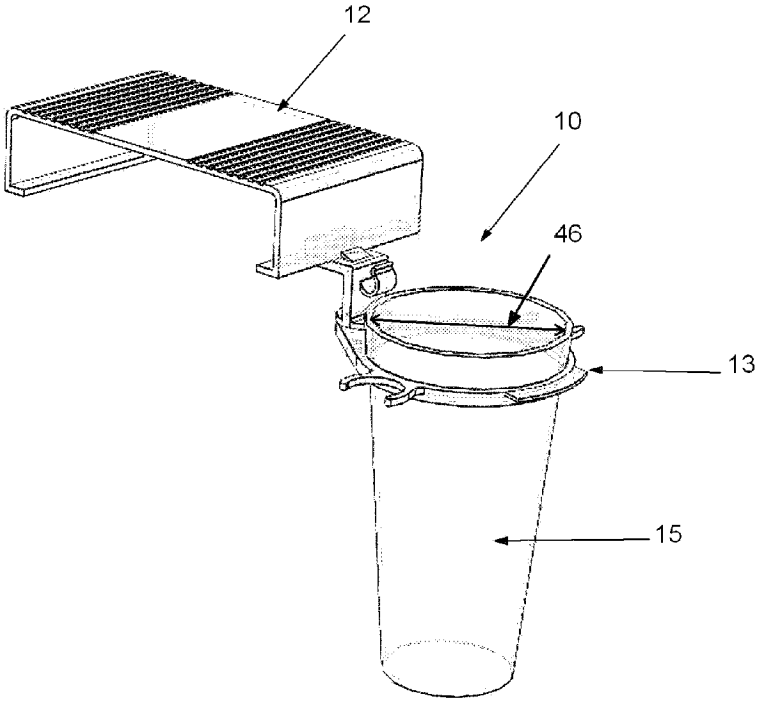
FIG. 4 is a perspective view of a first embodiment of the apparatus of the present invention.

FIG. 2 shows bleacher attachable cupholding device 10 assembled and ready for attachment to bleacher or stadium seat 12. Assembly is simply passing the cylindrical shaft 16 through the hole 6 of the support apparatus 1 and connecting (e.g. adhesive, gluing) the ring cap 2 in place at the tip of the shaft 16.

Figure 7:
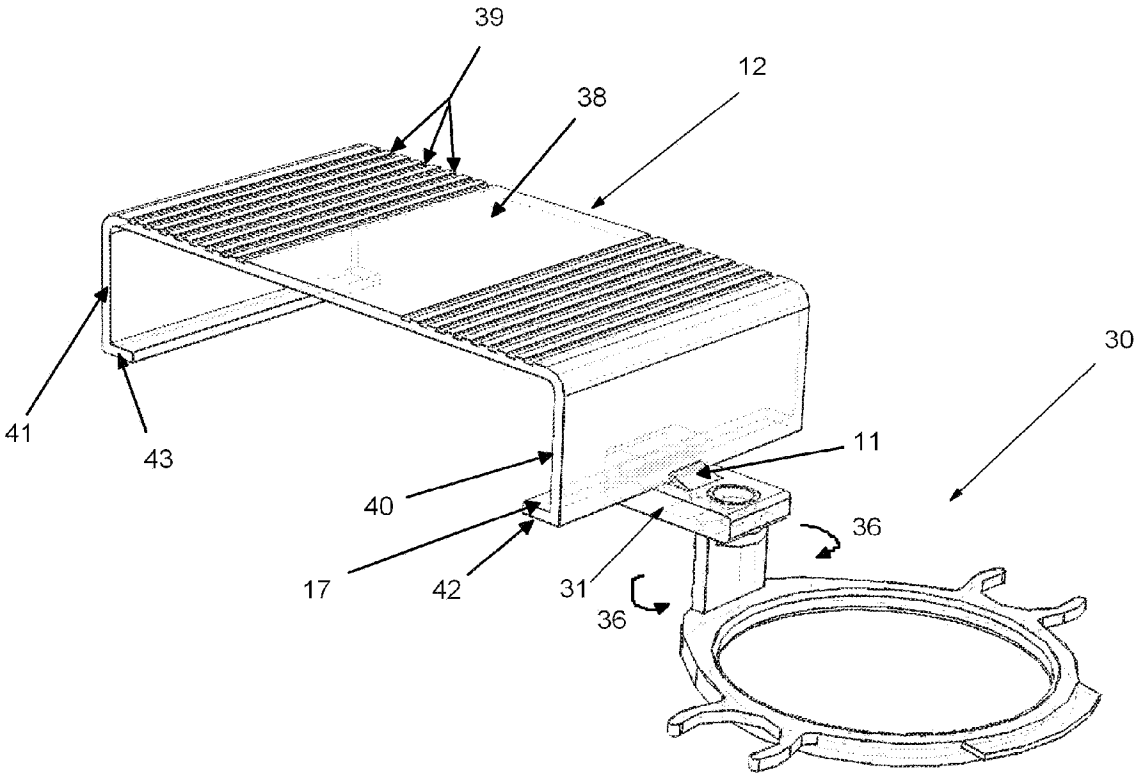
FIG. 7 is a perspective view of the second embodiment of the apparatus of the present invention.

In FIG. 7, bleacher or stadium seat 12 has an upper panel 38 having grooves 39, front and rear flanges or panels 40, 41 and bottom flanges or panels 42, 43. Panel 42 is a front bottom panel. Panel 43 is a rear bottom panel. In order to attach the clip/shaft bracket 3 to seat or bleacher 12, recess 44 in between clip 5 and flange 11 is receptive of front bottom panel 42 of bleacher seat 12 (see FIG. 7). In this position, flange 11 engages front panel 40.

Figure 5:
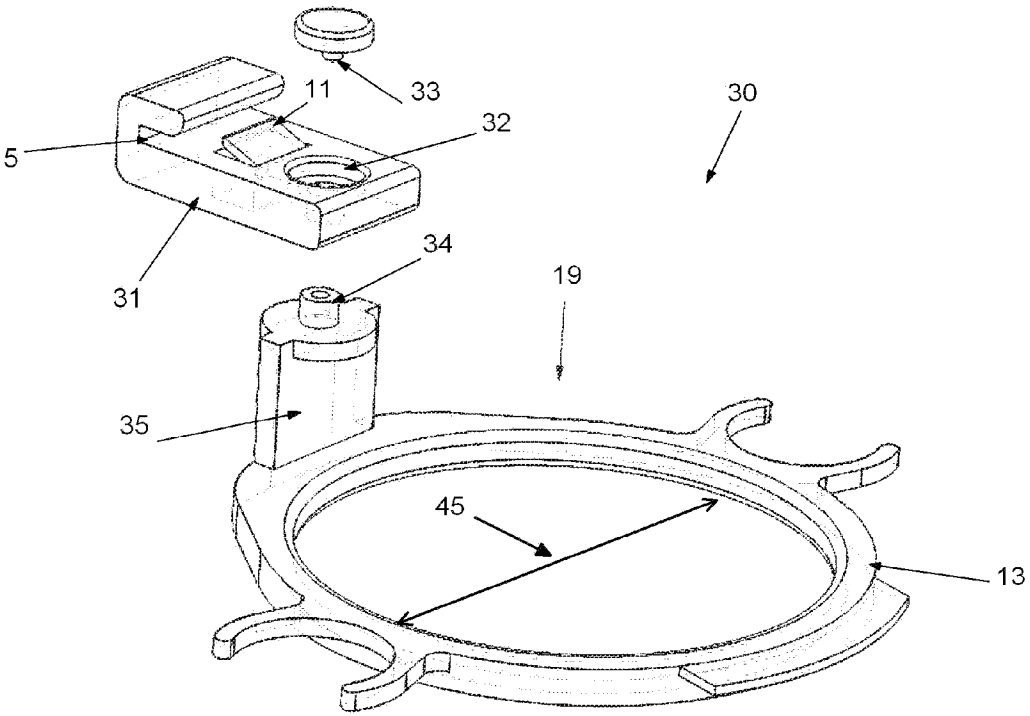
FIG. 5 is an exploded perspective view of a second embodiment of the apparatus of the present invention.
Figure 6:
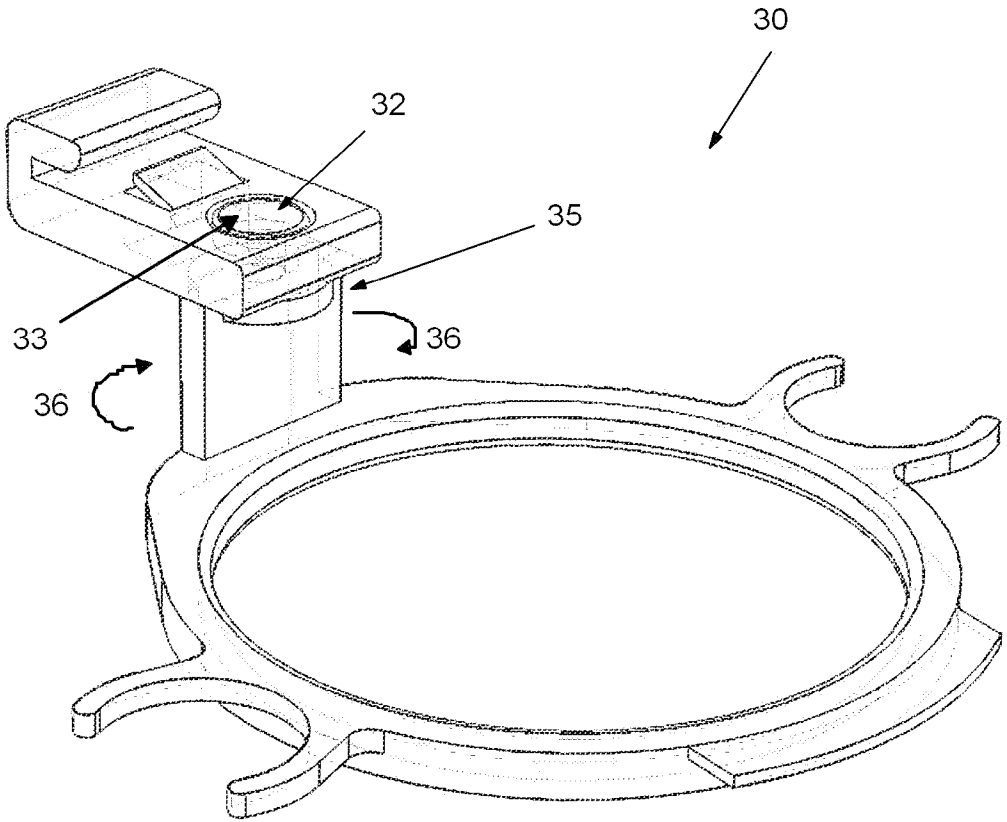
FIG. 6 is a perspective view of the second embodiment of the apparatus of the present invention.
Figure 8:
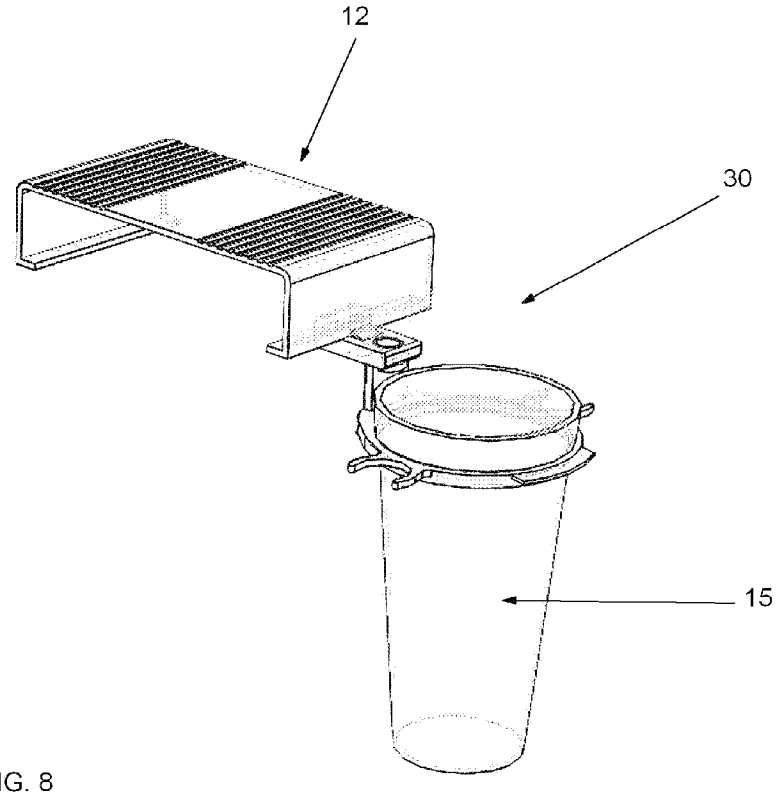
FIG. 8 is a perspective view of the second embodiment of the apparatus of the present invention.
Figure 9:
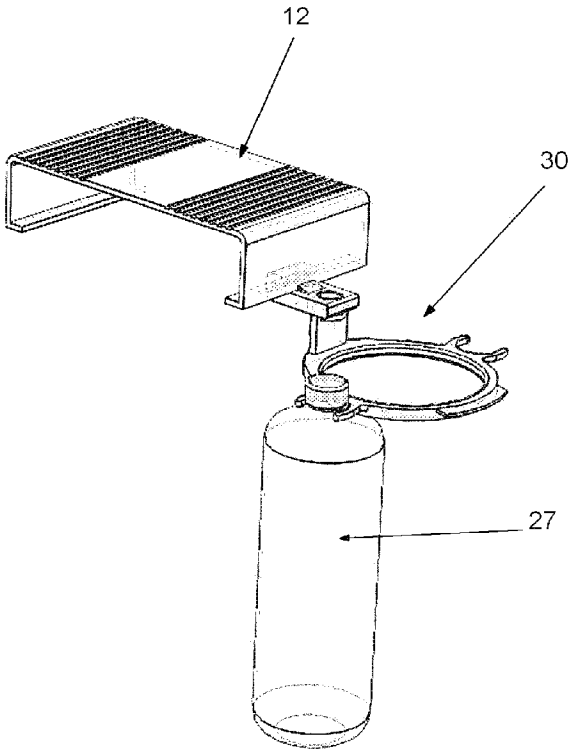
FIG. 9 is a perspective view of the second embodiment of the apparatus of the present invention.

FIG. 6 shows device 30 assembled with shaft 35 connected through hole 32 to cap 33. FIG. 7 shows device 30 attached to inner lip 17 of bleacher 12 via clip 31 which has been secured to front bottom flange 42. FIG. 8 shows cup 15 being supported by device 30 which is attached to a bleacher 12. FIG. 9 shows bottle 27 supported by device 30 which is attached to a bleacher 12. In FIG. 5, ring 13 is attached to vertical flat shaft 35 which is attached to cylindrical shaft 34. The parts 13, 34, 35 can be single piece, for example injection molded plastic. Shaft 34 extends through hole or opening 32 and is rotatably mounted in hole or opening 32, secured with cap 33 (using a fastener, bolt, screw, adhesive, etc.).

Figure 10:
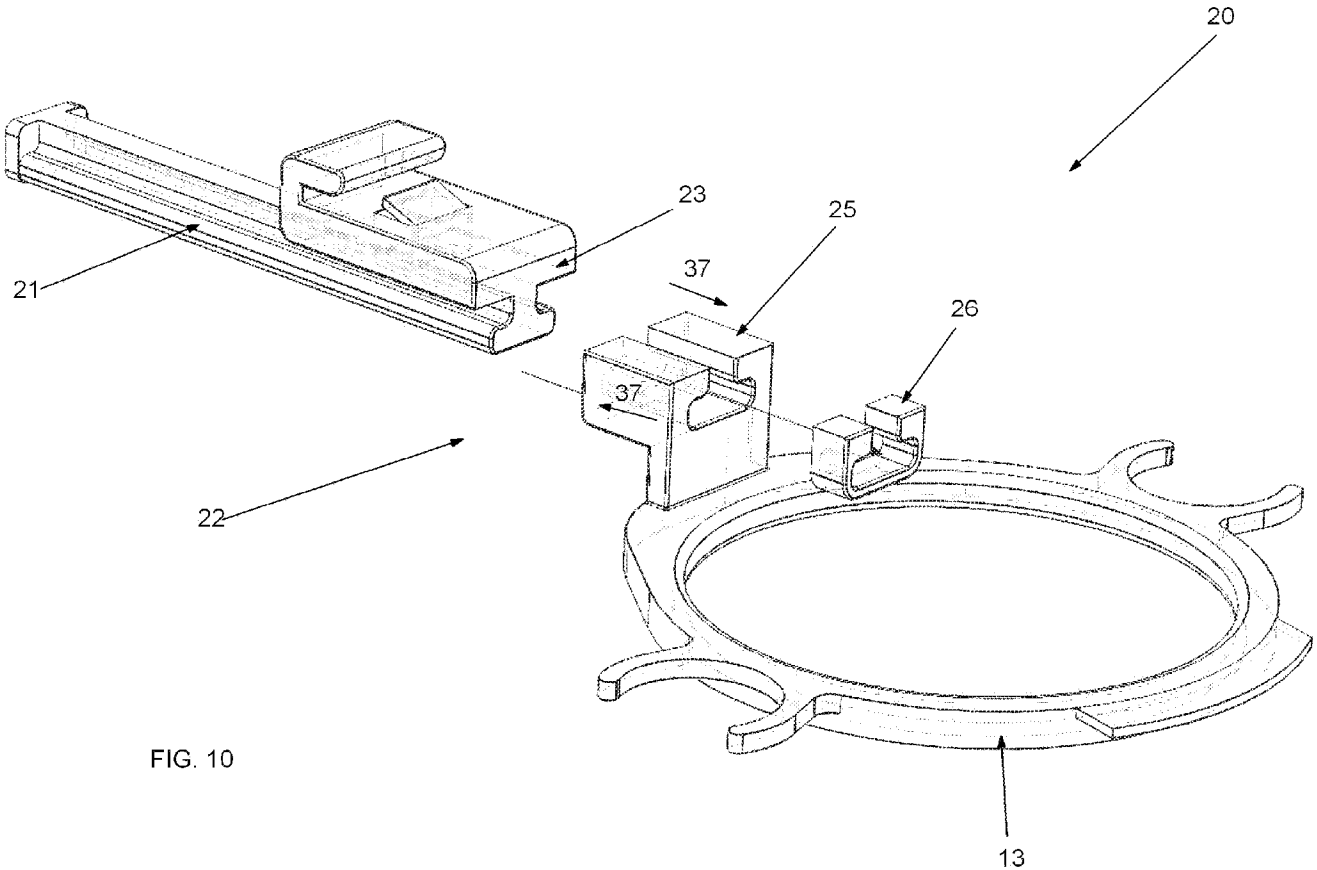
FIG. 10 is a perspective exploded view of the third embodiment of the apparatus of the present invention.
Figure 11:
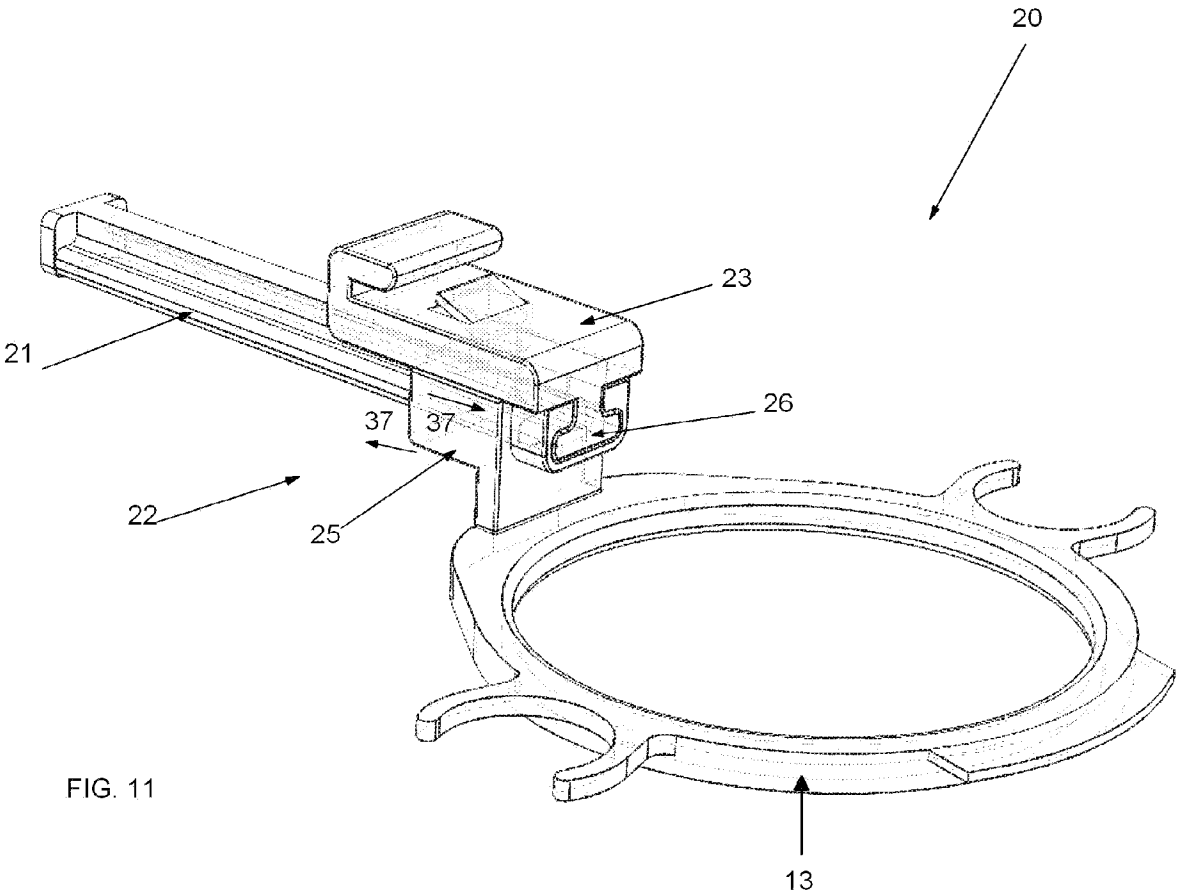
FIG. 11 is a perspective view of the third embodiment of the apparatus of the present invention.

FIG. 10 shows another embodiment of bleacher attachable cupholding device 20 in an exploded view. Device 20 comprising a clip 23 attached at the bottom in the center of clip 23 to a thin vertical shaft which attaches to the top middle section of a rail 21 which extends a few inches backward. On the rail 21 rides a snugly fitting car 25 attached to a ring 13, the rail 21 held on by a stop cap 26. FIG. 11 shows device 20 assembled with the car 25 attached to ring 13 riding on a rail 21 which is affixed to a clip 23 and held on by a stop cap 26.

Figure 12:
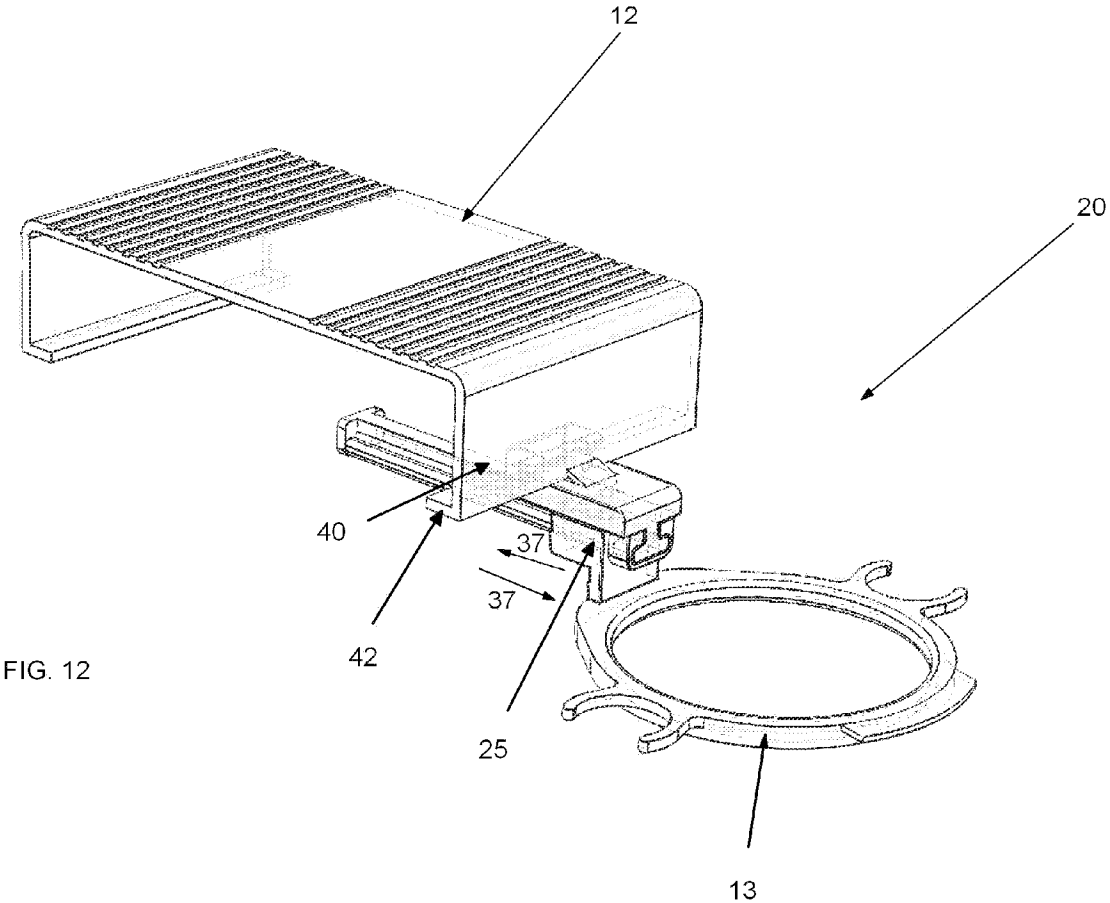
FIG. 12 is a perspective view of the third embodiment of the apparatus of the present invention.
Figure 13:
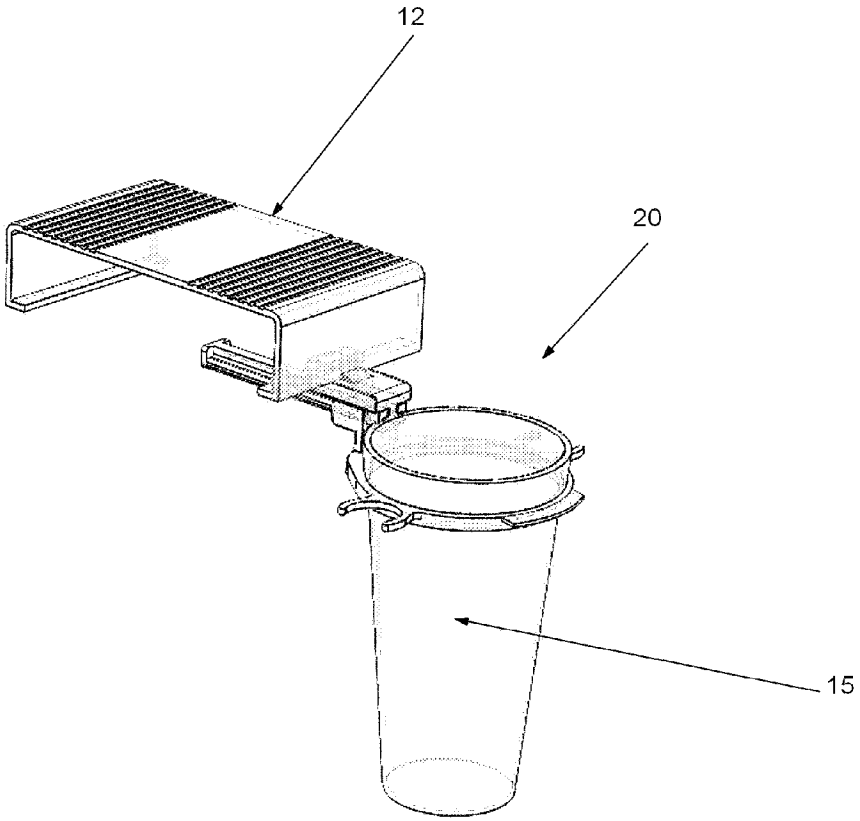
FIG. 13 is a perspective view of the third embodiment of the apparatus of the present invention.
Figure 14:
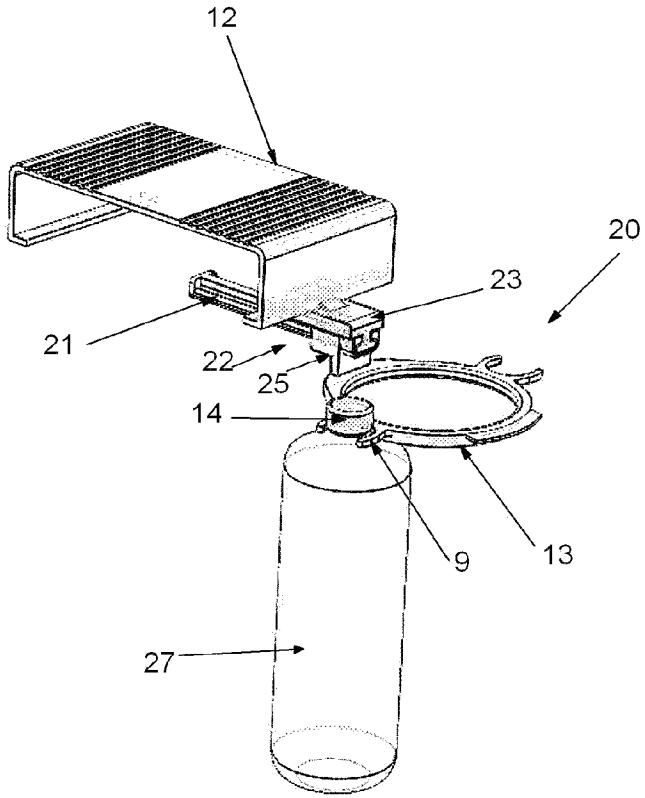
FIG. 14 is a perspective view of the third embodiment of the apparatus of the present invention.
Figure 15:
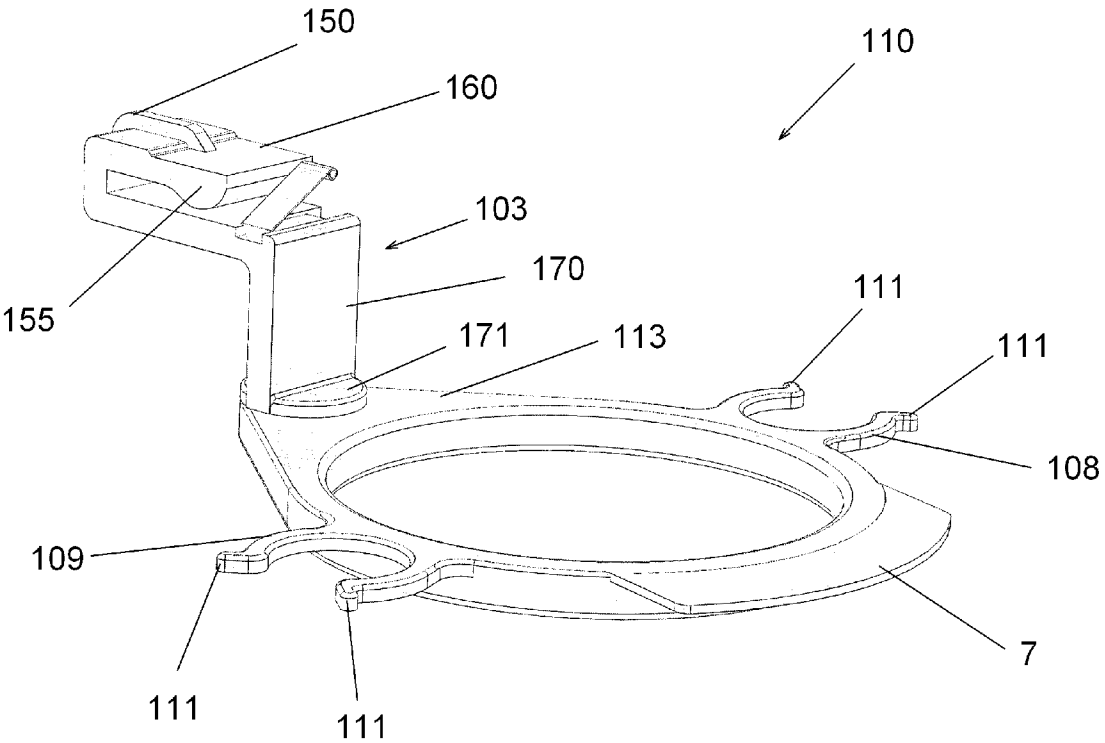
FIGS. 15-22 show a fourth embodiment of the present invention.
Figure 16:
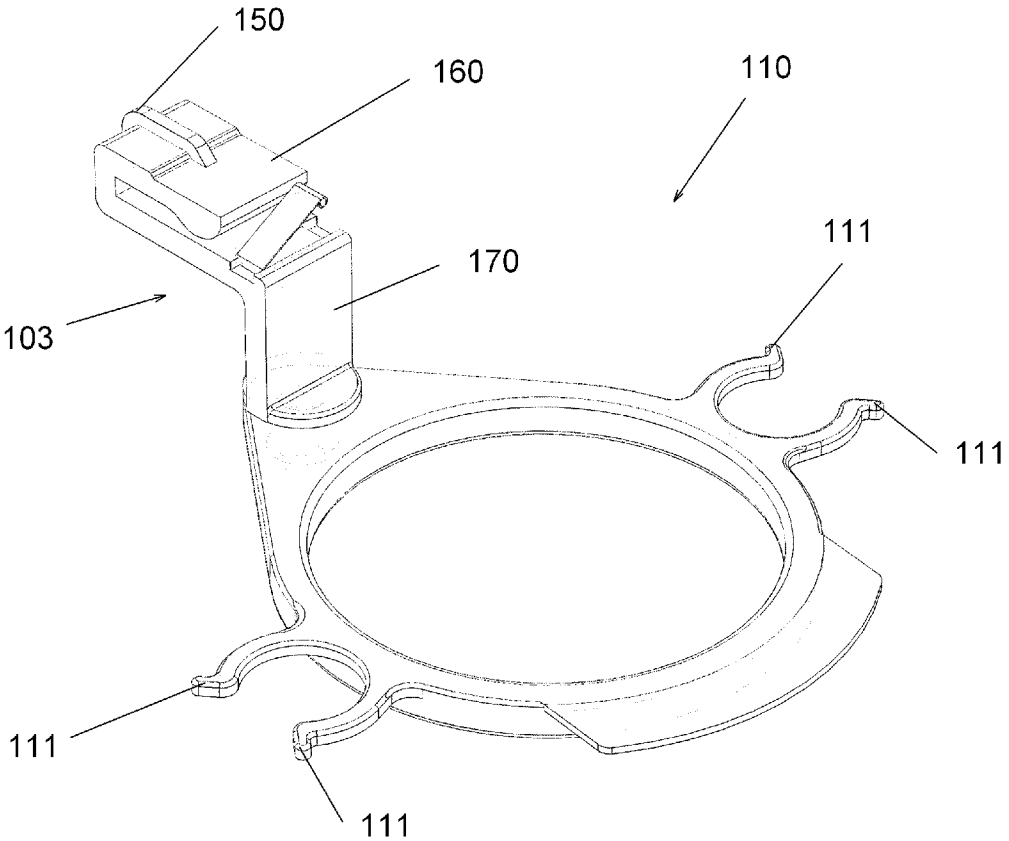

FIG. 12 shows device 20 attached to a bleacher 12 via the bleacher 12 front panel 40 and front bottom panels 42 with the car 25 and ring 13 combination able to move from a position in front of bleacher 12 (FIG. 12) to a position directly under bleacher 12. In FIG. 13, device 20 is attached to bleacher 12 and supporting cup 15 in its ring 13 in an extended position. FIG. 14 shows device 20 comprising a clip 23 attached at middle of bottom to a rail 21 supporting a sliding car 25 which is affixed to a ring 13 holding a bottle 27 held by extending flanges 9 encircling its neck 14. The device 20 is secured to a bleacher 12 via front panel 40 and front bottom panel 42 of bleacher 12. The car 25 slides between an extended position of FIG. 11 and a retracted or storage position wherein the car engages stop 22. Thus car 25 travels between stop 22 and stop cap 26 as illustrated by arrows 37 in FIG. 10.

Thus any of the embodiments of the apparatus of the present invention provides a holder that enables a cup, bottle, and or bag to be moved between an extended position and a stored position. In the extended position, the cup, bottle and or bag is placed toward the front of the stadium seat or bleacher 12 as shown in FIGS. 3, 4, 7, 8, 9, 11, 12, 13, 14. In the retracted position, the cup, bottle, bar or other similar object is moved to a storage position under the stadium seat 12. In one embodiment, a pivotal connection is formed between a bracket or clip that is attached to a seat and the holder which supports the cup, bottle, or bag. In another embodiment, the cup, bottle or bag is mounted to a support which includes a car that can slide between an extended and a retracted or storage position.

The present invention thus provides an improvement over prior art systems in that a user can access a cup, bottle or bag when desired. That same user can store the cup, bottle and or bag under his or her position in a stadium seat when the user does not wish to use the cup, bottle or bag. When supporting a cup, the cup would desirably have a larger diameter upper end 46 which is larger than the diameter or opening 45 of ring 13, thus a portion of the cup 15 extends through the opening 45 while the upper end portion which is of a larger diameter 46 than the opening 45 extends above ring 13 (see FIG. 4). It should be understood that the rail 21 and car 25 could have many different configurations. For example, the rail 21 could be cylindrically shaped with the car 25 having a circular opening that fits the cylindrical rail.

It should also be understood that other linkages could be used in addition to the pivotal linkage of FIGS. 1-9 or the sliding linkages of 10-14. For example, the linkages could employ multiple arms or multiple segments or joints which might pivot one upon another.

A fourth embodiment of the present invention, cup holder 110 (FIGS. 15-22) is similar to cup holder 10, and varies in just a few details. It includes a perimeter support rib 150. Rib 150 starts at the midpoint of the top of clip/shaft combination/bracket 103 and goes to back of clip 103, proceeds down back of clip 103 and all the way on underside of clip 103 to the flat part of the vertical component 170. The purpose of rib 150 is to strengthen the clip 103.

Figure 17:
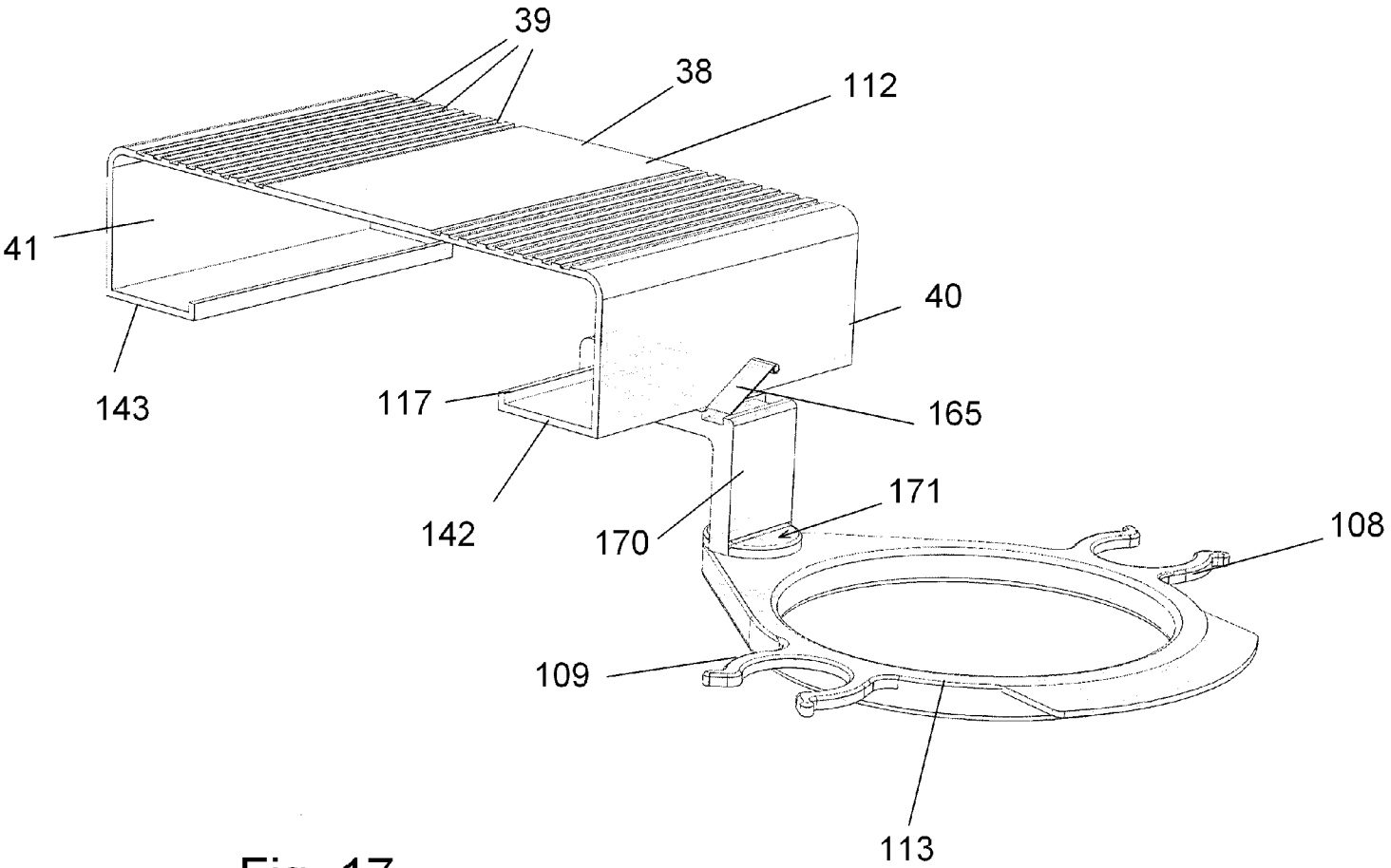
Figure 18:
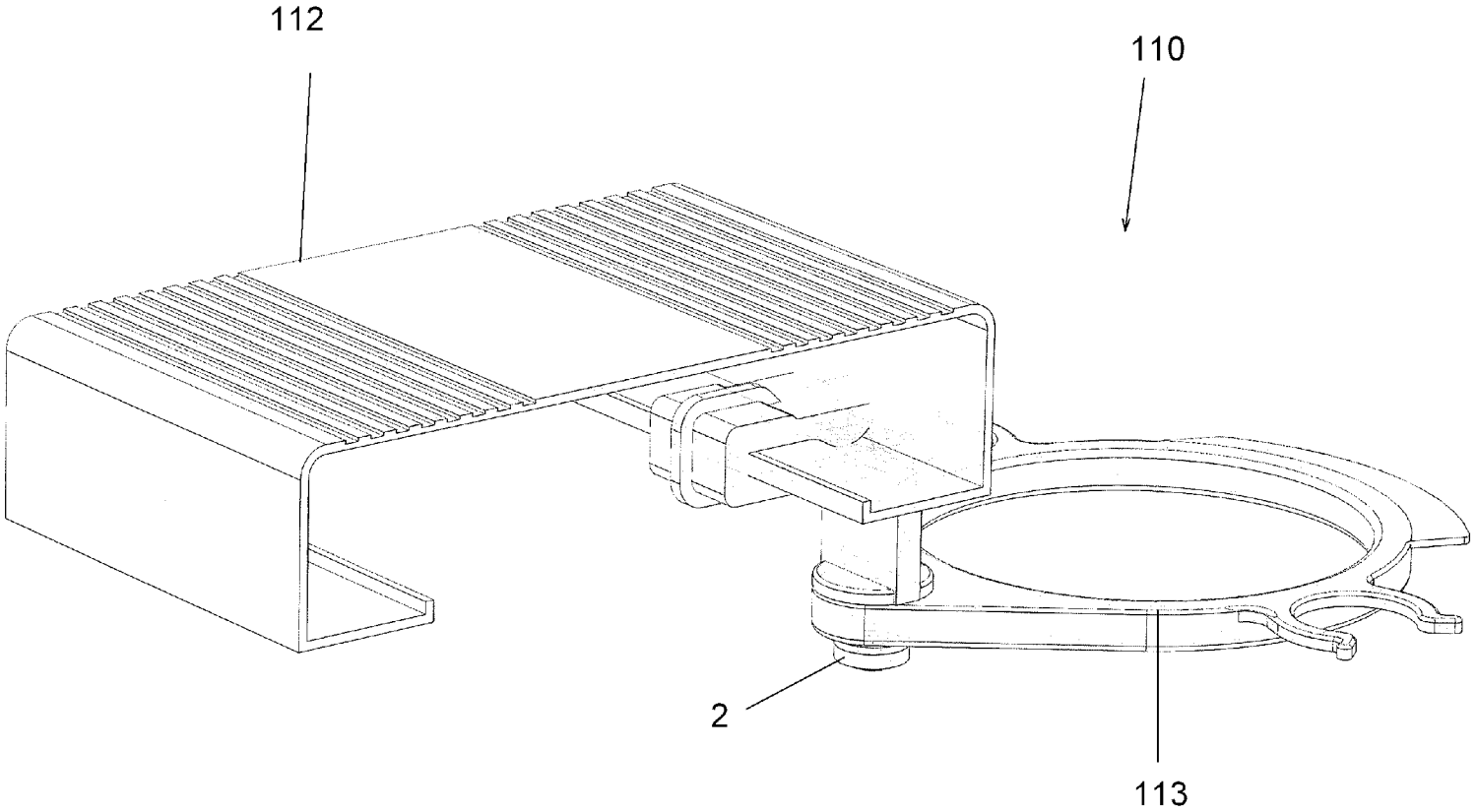
Figure 19:
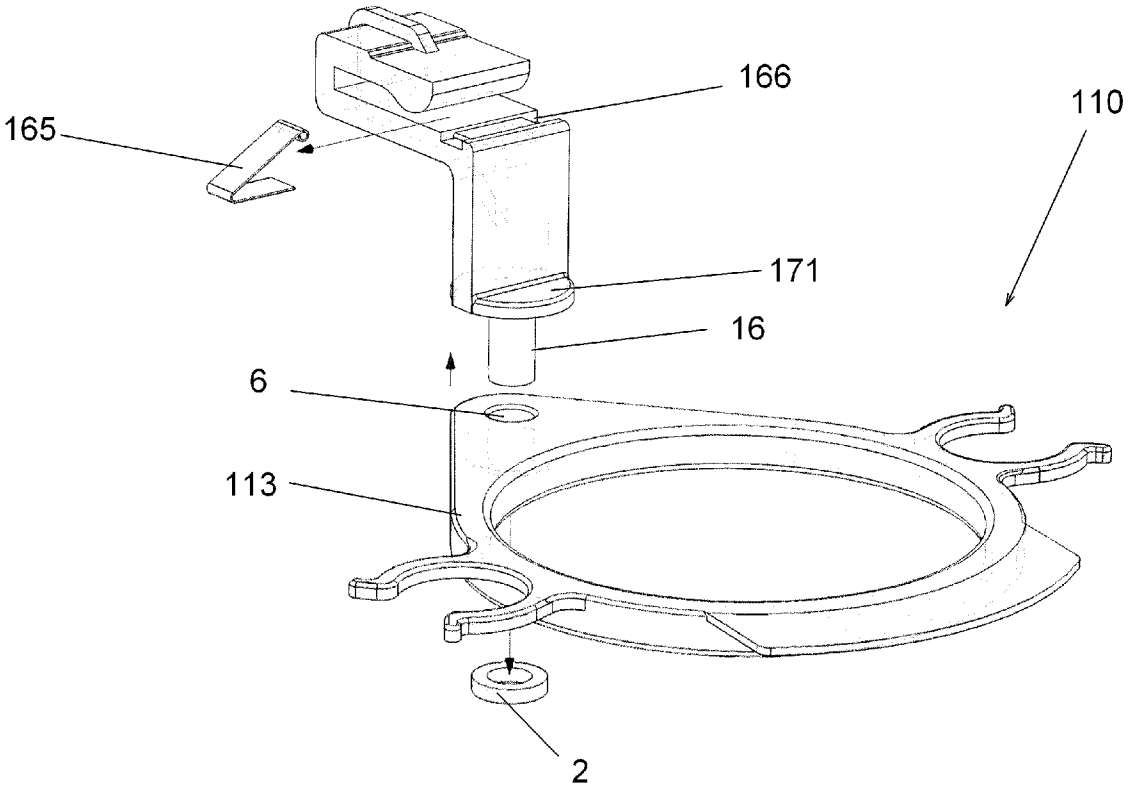
Figure 20:
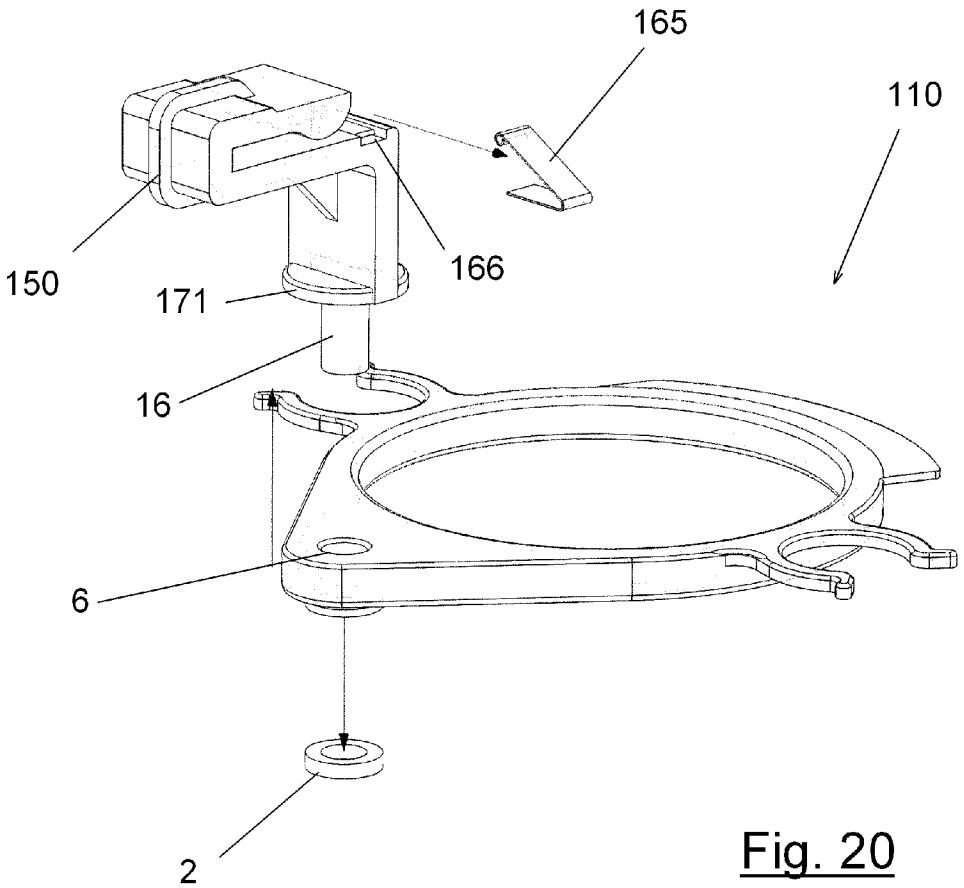
Figure 21:
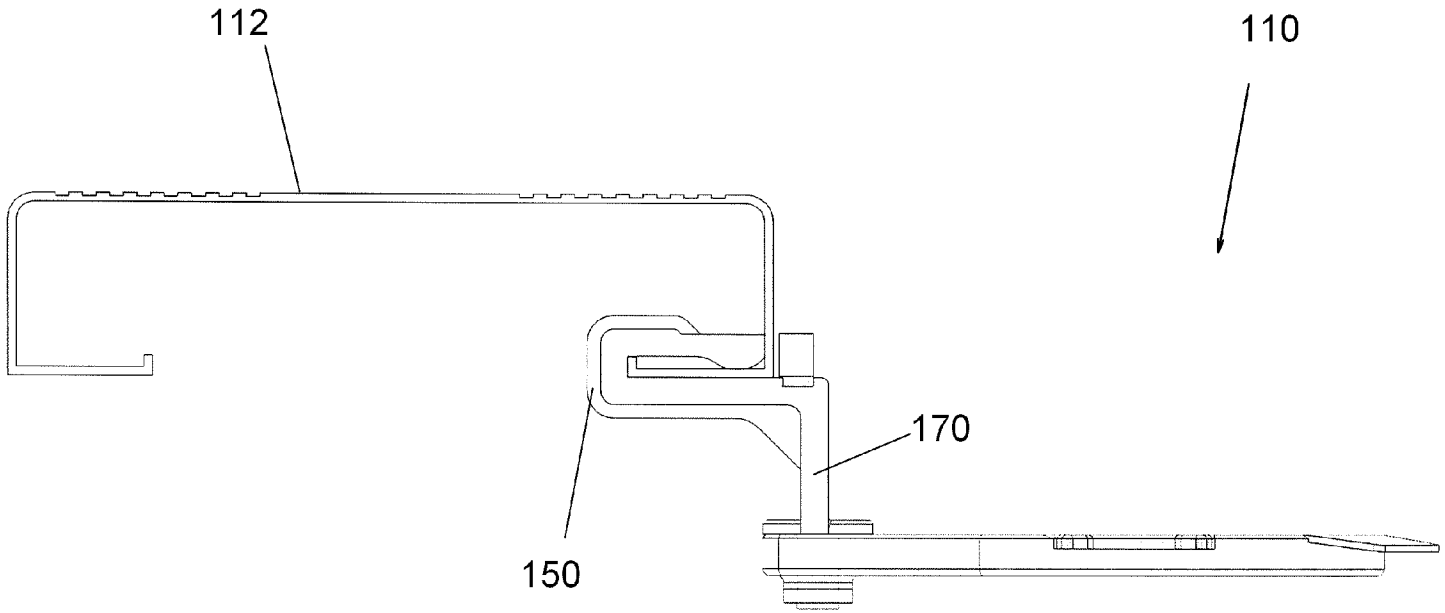
Figure 22:
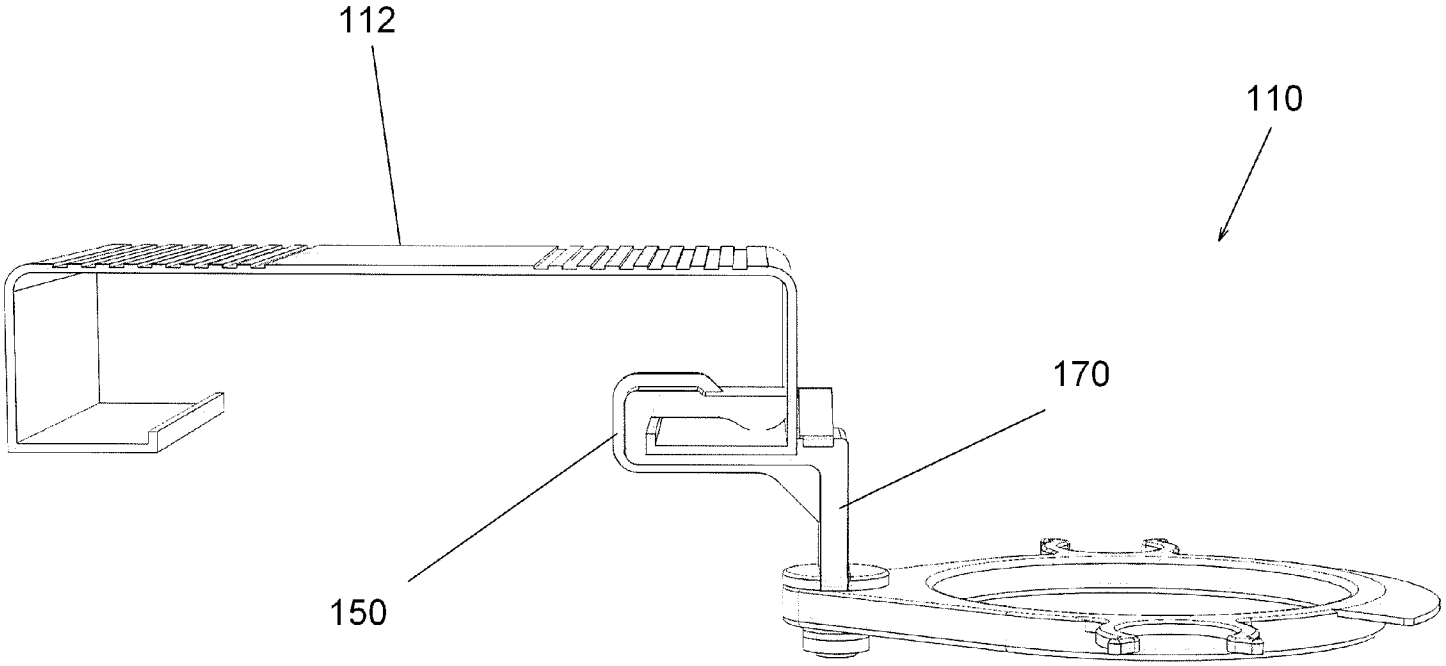
Figure 23:
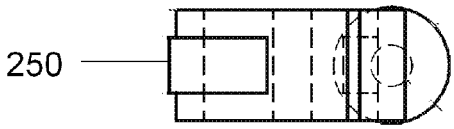
FIGS. 23-26 show a fifth embodiment of the present invention.
Figure 24:
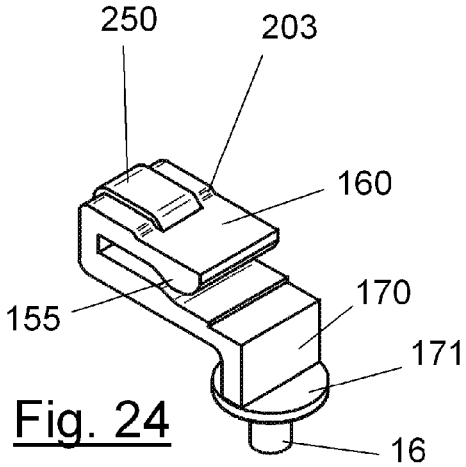
Figure 25:
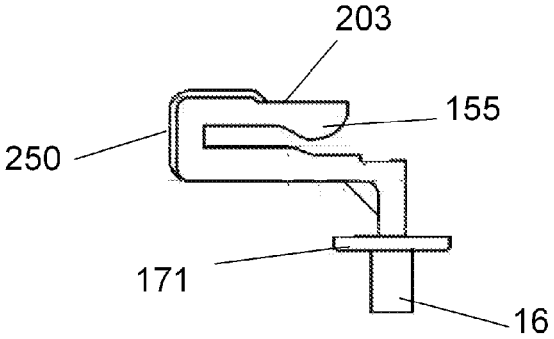
Figure 26:
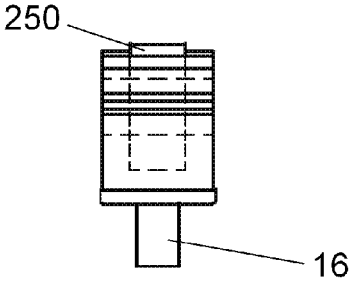

There is a downward projection 155 on the underside of top leg 160 of clip 103. The purpose of downward projection 155 is to hug the top part 117 of the bleacher lip on bleachers 112 that have a little nub 117 on the end of the lip, as shown in FIG. 17.

There is a metal spring 165 received in clip 103. This spring 165 serves the same purpose as the plastic stop 11 in FIG. 1 and is a movable projection. However, spring 165 rises from the side instead of in front and going back toward clip. The spring 165 can also be made as part of the mold (in which case it would be the same plastic) instead of being a separate metal piece inserted into slit 166 as shown in FIGS. 15-20. Though not shown in FIGS. 23-26, clip 203 preferably has such a molded spring in roughly the same position as metal spring 165 on clip 103.

Instead of gluing ring 2 to shaft 16, one could instead for example:

(1) provide a form fitting cap which could be sonically welded to end of cylindrical shaft 16;

(2) provide a retaining ring (made of metal, for example) with three prongs which are inserted into three holes made toward the end of cylindrical shaft 16 and are at evenly spaced intervals circumnavigating shaft 16.

(3) provide a modified end of shaft 16 in the form of a barbed lock which is inserted through the sleeve (hole) 6 in the apex of the cupholding ring using a mechanical press. It pops out of the bottom of the sleeve and can not go back thus securing the cupholding ring to the shaft.

(4) provide a four-pronged cored out barbed lock which operates similarly but does not have to be mechanically pressed.

(5) provide a two-pronged split tail barbed lock which serves the same purpose only using two prongs instead of four.

Tab 171 is connected to the top of shaft 16 and contacts ring 113 when shaft 16 is inserted through the sleeve (hole) 6 (see FIGS. 15-22).

Clip 203 shown in FIGS. 23-26 is similar to clip 103. It differs primarily in that vertical component 170 is shorter and rib 250 is wider than rib 150 and does not extend as far. Also, a molded plastic spring (not shown) is preferably used.

Curved flange/hangers 108, 109 shown in FIGS. 15-22 are similar to flanges 8, 9. They differ primarily in that flanges 108, 109 have flange ears 111 located at the end of each flange. Flange ears 111 can be used to assist the narrowed portion of a bottleneck 14 of bottle 27 to enter into and securely rest in flanges 108, 109.

To attached cup holder 110 to bleacher 112, clip 103 is moved forward and around bleacher 112 so that downward projection 155 hugs the top part 117 of the bleacher lip. To detach cup holder 110, clip 103 is moved away from the bleacher forward panel 40. Spring 165 engages front panel 40.

PARTS LIST

The following is a list of parts and materials suitable for use in the present invention:

Part Number Part Name
1 cup/bottle support
2 retainer/ring cap
3 clip/shaft combination/bracket
4 upwardly curved shaker holding flange
5 lip clip
6 opening/hole
7 trash bag mount/hanger
8 curved flange/hanger
9 curved flange/hanger
10 bleacher attachable cup holding device
11 angled flange
12 bleacher rail/stadium seat
13 ring
14 bottle neck
15 cup
16 cylindrical shaft/post
17 inner lip
19 cup/bottle holding apparatus
20 bleacher attachable cup holding device
21 rail
22 stop
23 clip
25 car
26 stop cap
27 bottle
30 bleacher attachable cup holding device
31 clip
32 hole/opening
33 cap
34 cylindrical shaft
35 vertical flat shaft
36 arrow indicating rotation of ring 13
37 arrow indicating sliding movement of car 25
38 upper panel
39 groove
40 forward flange or panel
41 rear flange or panel
42 front bottom panel
43 rear bottom panel
44 recess
45 opening
46 larger diameter upper end
103 clip/shaft combination/bracket
108 curved flange/hanger
109 curved flange/hanger
110 bleacher attachable cup holding device
111 flange ears
112 bleacher
113 ring
117 inner lip of bleacher 112
142 front bottom panel
143 rear bottom panel
150 perimeter support rib
155 downward projection
160 top leg
165 spring
166 slit
170 vertical component
171 tab
203 clip
250 perimeter support rib All measurements disclosed herein are at standard temperature and pressure, at sea level on Earth, unless indicated otherwise. The foregoing embodiments are presented by way of example only; the scope of the present invention is to be limited only by the following claims.

The invention claimed is:

1. A stadium seat cup holder for use with a stadium seat having an upper seating panel and multiple flanges that extend downwardly from said upper seating panel including at least one vertical flange and at least one laterally extending flange connected to said vertical flange, comprising;

a) a bracket that is configured to form an attachment to the stadium seat below said upper seating panel, wherein the bracket affixes to both the vertical and laterally extending flanges of the stadium seat;

b) at least one forwardly opening recess on the bracket that is connected to and receives said laterally extending flange of the stadium seat, a downward projection on the bracket which engages the laterally extending flange when the flange is in the recess, and a movable projection formed as an element separate from the bracket, the movable projection positioned in front of the laterally extending panel and the recess when the bracket is connected to the stadium seat;

c) a cup holder that is movably mounted to the bracket, wherein the cup holder is movable between extended and retracted positions;

d) wherein in the extended position, the cup holder is placed in front of the stadium seat; and e) wherein in the retracted position, the cup holder is placed below the laterally extending flange and under the stadium seat.

2. The stadium seat cup holder of claim 1 wherein the cup holder is pivotally attached to the bracket.

3. The stadium seat cup holder of claim 1 wherein the cup holder is slideably attached to the bracket.

4. The stadium seat cup holder of claim 1 wherein the cup holder has a recess that is sized and shaped to receive a cup therein.

5. The stadium seat cup holder of claim 1 wherein the cup holder includes an annular portion having an opening that is sized and shaped to receive a cup therein.

6. The stadium seat cup holder of claim 1 wherein the cup holder includes an annular portion having an outer edge and a fitting thereon for holding a bottle that is on the outer edge of the annular portion.

7. The stadium seat cup holder of claim 6 wherein the cup holder has a fitting thereon for engaging the neck of a bottle, wherein the bottle is supported by and suspended from the fitting at a position spaced away from the opening.

8. The stadium seat cup holder of claim 1 wherein the cup holder has a fitting thereon for holding a trash bag.

9. The stadium seat cup holder of claim 1 wherein the cup holder has a fitting thereon for holding a shaker.

10. The stadium seat cup holder of claim 1 wherein the cup holder has a ring shape.

11. A stadium seat cup holder for use with a stadium seat having an upper horizontal seating panel, a vertical panel extending down from the upper horizontal seating panel, and a laterally extending panel spaced below the upper seating panel and connected to the vertical panel, comprising;

a) a bracket that is configured to form an attachment to the stadium seat wherein the bracket affixes to both the vertical and laterally extending panels of the stadium seat;

b) at least one forwardly opening recess on the bracket that receives the laterally extending panel of the stadium seat, a downward projection on the bracket which engages the laterally extending panel when the panel is in the recess, and a movable projection formed as an element separate from the bracket, the movable projection positioned in front of the laterally extending panel and the recess when the bracket is connected to the stadium seat; and c) a cup holder that is movably mounted to the bracket at a pivotal connection that is below the vertical and laterally extending panels, wherein the cup holder has a central opening and a fitting for holding a bottle that is spaced away from said central opening.

12. The stadium seat cup holder of claim 11 wherein the holder has a fitting for holding a trash bag.

13. The stadium seat cup holder of claim 11 wherein the holder has a fitting for holding a shaker.

14. A stadium seat cup holder for use with a stadium seat having an upper seating panel with forward and rear portions, and multiple flanges including a laterally extending flange, which flanges extend below the forward portion of said seating panel, comprising;

a) a bracket that is configured to form a removable connection to the stadium seat below the upper seating panel, wherein the bracket affixes to the flanges of the stadium seat in a connected position;

b) at least one forwardly opening recess on the bracket that receives said flanges of the stadium seat in said connected position, a downward projection on the bracket which engages the laterally extending flange when the laterally extending flange is in the recess, and a movable projection formed as an element separate from the bracket, the movable projection positioned in front of the flanges and the recess when the bracket is connected to the stadium seat;

c) a cup holder that is movably mounted to the bracket, wherein the cup holder is movable between extended and retracted positions;

d) wherein in the extended position, the cup holder is placed in front of the stadium seat;

e) wherein in the retracted position, the cup holder is placed below and behind the flanges and under the stadium seat; and f) wherein the bracket has a downwardly extending portion with a pivotal connection spaced below the recess, the cup holder attached to the bracket at the pivotal connection.

* * * * *